US008811653B2

(12) United States Patent
Hiramoto

(10) Patent No.: US 8,811,653 B2
(45) Date of Patent: Aug. 19, 2014

(54) SPEAKER UNIT

(75) Inventor: Mitsuhiro Hiramoto, Kobe (JP)

(73) Assignee: Fujitsu Ten Limited, Kobe (JP)

( * ) Notice: Subject to any disclaimer, the term of this patent is extended or adjusted under 35 U.S.C. 154(b) by 308 days.

(21) Appl. No.: 13/285,639

(22) Filed: Oct. 31, 2011

(65) Prior Publication Data

US 2012/0140977 A1 Jun. 7, 2012

(30) Foreign Application Priority Data

Dec. 6, 2010 (JP) ..... 2010-271617

(51) Int. Cl.
*H04R 9/06* (2006.01)
*H04R 1/02* (2006.01)

(52) U.S. Cl.
USPC ..... 381/433; 381/423

(58) Field of Classification Search
CPC ..... H04R 1/00; H04R 1/02; H04R 9/02; H04R 9/025; H04R 9/06; H04R 31/006
USPC ..... 381/423, 433
See application file for complete search history.

(56) References Cited

U.S. PATENT DOCUMENTS 7,184,568 B2 * 2/2007 Chan ..... 381/433
7,720,248 B2 * 5/2010 Sasaki et al. ..... 381/433
2003/0227225 A1 12/2003 Kaneda et al.
2006/0171557 A1 8/2006 Chan
2011/0013798 A1 1/2011 Niidera et al.

FOREIGN PATENT DOCUMENTS

| | | |
|---|---|---|
| CN | 1463207 A | 12/2003 |
| JP | A-2002-125293 | 4/2002 |
| JP | A-2002-142290 | 5/2002 |
| JP | A-2007-158993 | 6/2007 |
| JP | A-2008-193371 | 8/2008 |
| JP | A-2011-124821 | 6/2011 |
| JP | A-2012-019254 | 1/2012 |
| WO | WO 2009/118892 | 10/2009 |

OTHER PUBLICATIONS

Nov. 12, 2013 Office Action issued in Chinese Patent Application No. 201110331540.4 (with translation).
Mar. 4, 2014 Office Action issued in Japanese Patent Application No. 2010-271617 (with translation).
Chinese Office Action dated May 15, 2014 from Chinese Patent Application No. 201110331540.4 (with English-language translation).

* cited by examiner

*Primary Examiner* — Brian Ensey
(74) *Attorney, Agent, or Firm* — Oliff PLC

(57) ABSTRACT

A speaker unit includes a frame that secures a diaphragm of a speaker at an outer circumference of the diaphragm, a magnetic circuit, a first leg that extends from a portion of an inner wall of the frame in a vicinity of a front of the speaker to the magnetic circuit, and that secures the magnetic circuit to the frame, and a second leg that extends from a portion of the inner wall of the frame in a vicinity of a rear of the speaker to the magnetic circuit, and that secures the magnetic circuit to the frame.

12 Claims, 17 Drawing Sheets

SPEAKER UNIT

BACKGROUND OF THE INVENTION

1. Field of the Invention

The invention relates to a speaker supporter supporting a speaker diaphragm and a magnetic circuit and to a speaker unit including the speaker supporter.

2. Description of the Background Art

FIG. 1 shows a sectional view of a structure of a speaker unit. A speaker unit 1 includes a vibrating part, a speaker supporter, and a magnetic circuit part. The vibrating part has a diaphragm 11, a voice coil 12, a voice coil bobbin 13, and a damper 14.

The diaphragm 11 vibrates in response to an electrical signal input to the voice coil 12, which emits a sound corresponding to the input signal. The diaphragm 11 is made of pulp, resin, or other materials. The center part of the diaphragm 11 is attached and secured to one end of the cylinder of the voice coil bobbin 13. The opening part of the diaphragm 11 is attached and secured to an edge part 15. The outer circumference part of the edge part 15 is attached and secured to a speaker supporter 20.

The outer circumference of the voice coil bobbin 13 securing the diaphragm 11 is attached to the inner circumference of the damper 14. The outer circumference of the damper 14 is attached to the speaker supporter 20. Therefore, the diaphragm 11 is attached and secured to the edge part 15 and damper 14 in a hanging state.

The voice coil bobbin 13 is made of a light member such as paper, resin, or aluminum formed into a cylindrical shape. An insulated copper or aluminum thin wire is coiled on the outer circumference of the cylindrical shape, which forms the voice coil 12. The damper 14, made of resin or blended fabric, supports the diaphragm 11 so that the diaphragm 11 can move in response to the vibrations of the voice coil bobbin 13.

The magnetic circuit part has a ring permanent magnet 30 (hereafter, abbreviated to as a magnet 30), a bottom yoke 31, and a top plate 32. In the magnetic circuit part, the bottom yoke 31 and the top plate 32 are attached to both end faces of the magnet 30 for securing.

The bottom yoke 31 has a center pole 33 having a cylindrical shape and a flange part 34 having a spread shape at one end face of the center pole 33. On the bottom yoke 31 made of magnetic carbon steel or the like, a protective coating against corrosion is applied after shaping by cutting process or the like. The shape of the top plate 32 is a washer. On the top plate 32 made of magnetic rolled steel plate or the like, a protective coating against corrosion is applied after shaping such as press working.

The speaker supporter 20 is a member supporting the magnetic circuit part and the vibrating part. The vibrating part is secured inside the speaker supporter 20. The magnetic circuit part is secured at the rear portion (right side in FIG. 1) of the speaker supporter 20. The speaker supporter 20 is made of resin or other materials.

As shown by an arrow 90, in the specification, "forward" or "front side" of a speaker or the speaker unit 1 refers to the side where the diaphragm 11 is installed (left side in FIG. 1) in terms of the speaker unit 1. As well, "Backward" or "rear side" of the speaker or the speaker unit 1 refers to the side where the magnetic circuit part is installed (right side in FIG. 1) in terms of the speaker unit 1.

FIG. 2 shows a rear view of the speaker supporter 20. FIG. 3 shows a perspective view of the speaker supporter 20. The speaker supporter 20 has a frame 21, a retainer 22, a leg 23*a*, a leg 23*b*, a leg 23*c*, a leg 23*d*, a leg 23*e*, and a leg 23*f*.

Hereafter, the legs 23*a* to 23*f* may be described collectively as "legs 23" (or "leg 23" for one of the legs 23) without suffixes of "a," "b" or others.

The frame 21 secures the edge part 15 attached and secured to the outer circumference of the diaphragm 11. That is, the outer circumference of the diaphragm 11 is secured to the frame 21 through the edge part 15. The retainer 22 supports the magnetic circuit part. Six of the legs 23*a* to 23*f* extend from the inner wall of the frame 21 in the vicinity of the front of the speaker, and connect to the retainer 22. This secures the retainer 22 to the frame 21.

An attaching surface 24 is formed on the outside wall of the frame 21. The speaker unit 1 is installed with the attaching surface 24 screwed to the mounting surface of the intended installation position.

Another structure is proposed for the case where a flange part is formed at the end part of a frame, and a speaker unit is installed at the outer peripheral of an installation hole on the installation position. One end of the flange part has an engaging part to engage with the installation position through the installation hole and another end of the flange part has an auxiliary member for installation having elastic characteristics to be locked at the installation position through the installation hole.

Conventionally, the mass of a speaker unit is reduced by the use of a downsized magnetic circuit part or lighter material for a frame or legs.

SUMMARY OF THE INVENTION

According to one aspect of the invention, a speaker unit includes a frame that secures a diaphragm of a speaker at an outer circumference of the diaphragm, a magnetic circuit, a first leg that extends from a portion of an inner wall of the frame in a vicinity of a front of the speaker to the magnetic circuit, and that secures the magnetic circuit to the frame; and a second leg that extends from a portion of the inner wall of the frame in a vicinity of a rear of the speaker to the magnetic circuit, and that secures the magnetic circuit to the frame.

A connection point between the frame and the first leg is arranged on the inner wall of the frame in the vicinity of the front of the speaker, and a connection point between the frame and the second leg is arranged in the vicinity of the rear, respectively. This structure enables the speaker unit to be lighter while keeping strength of the speaker unit.

According to another aspect of the invention, the speaker unit includes a plurality of leg combinations each including at least one of the first legs and at least one of the second legs, wherein the first leg and the second leg included in one of the leg combinations are spaced from each other by a first interval that is smaller than a second interval by which adjacent leg combinations are spaced from each other.

The first leg and the second leg are made into a combination and arranged closer to each other. This structure provides stronger resistance force against deformation force applied to the speaker unit.

Therefore, the object of the invention is to provide a lighter speaker unit while strength of the speaker unit is kept.

These and other objects, features, aspects and advantages of the invention will become more apparent from the following detailed description of the invention when taken in conjunction with the accompanying drawings.

DESCRIPTION OF THE EMBODIMENTS

Figure 4:
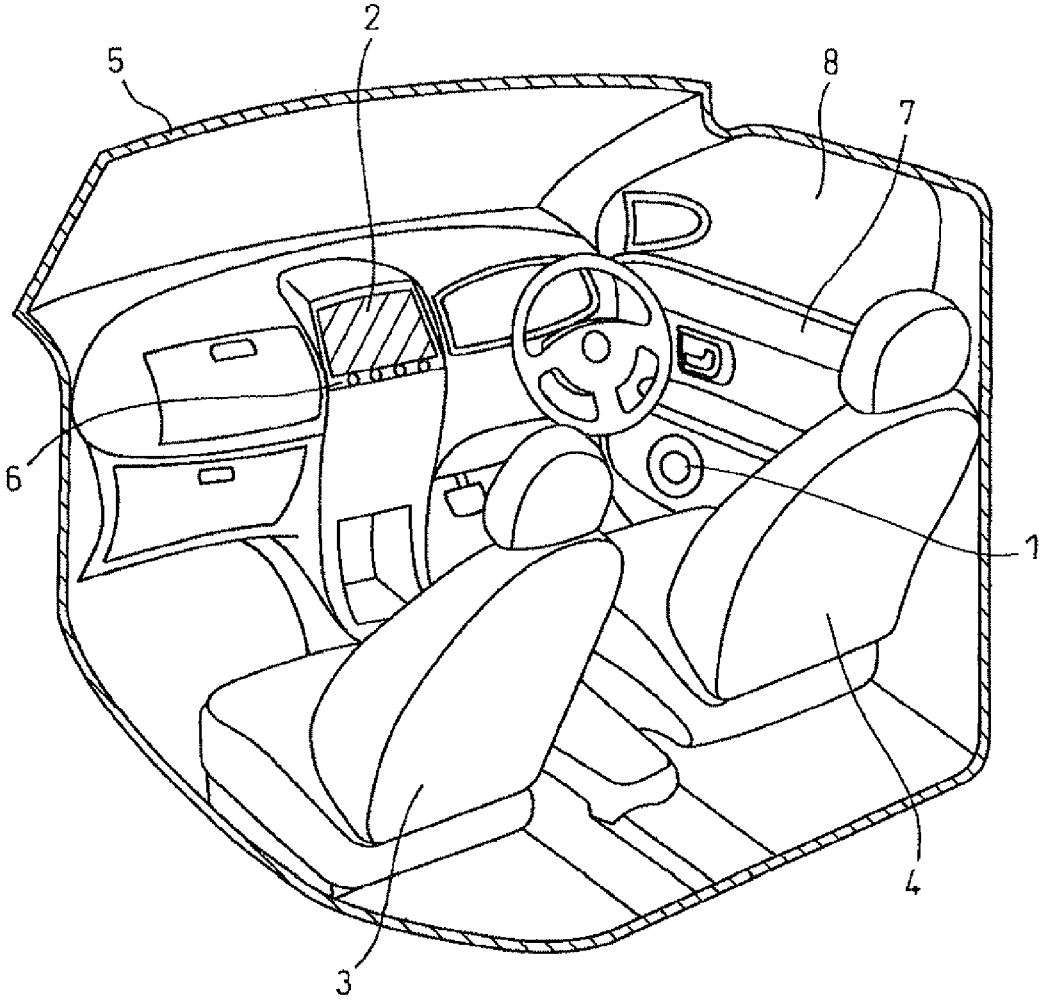
FIG. 4 shows a perspective view of an installation example of the speaker unit in a vehicle.

Hereinafter, some embodiments will be described in reference to attached drawings. The following speaker units are adaptable to a wide variety of use applications. However, this specification describes the cases where speaker units are adopted as in-vehicle speaker units for installation in vehicles. FIG. 4 shows a perspective view of an installation example of a speaker unit in a vehicle.

As shown in FIG. 4, the vehicle is equipped with a combined apparatus 2 (hereinafter, referred to as an AVN (audio visual navigation) apparatus 2) that includes a navigation function, an audio player function, and a video player function. The audio player function plays radio broadcast and audio signals stored in recording media such as a compact disc (CD) or a HAD, and the video player function plays television broadcast and video signals stored in recording media such as a digital versatile disk (DVD) or a HDD.

The AVN apparatus 2 is installed almost at the center between a driver's seat 4 and an assistant seat 3. A display of the AVN apparatus 2 has, for example, a liquid-crystal display element. A user operation to the AVN apparatus 2 is done on a touch screen having a transparent-film switch placed on a front side of the display or on an operation part having physical buttons, or by using an infrared remote control or a radio remote control.

The speaker unit 1 is installed on a door trim 7 that is the interior of a vehicle door. The speaker unit 1 outputs sounds and alarm sounds in conjunction with images displayed on the display of the AVN apparatus 2. A reference number 7 in FIG. 4 shows a door trim that is the interior inside a door, and a reference number 8 shows a window glass installed in a door.

Figure 1:
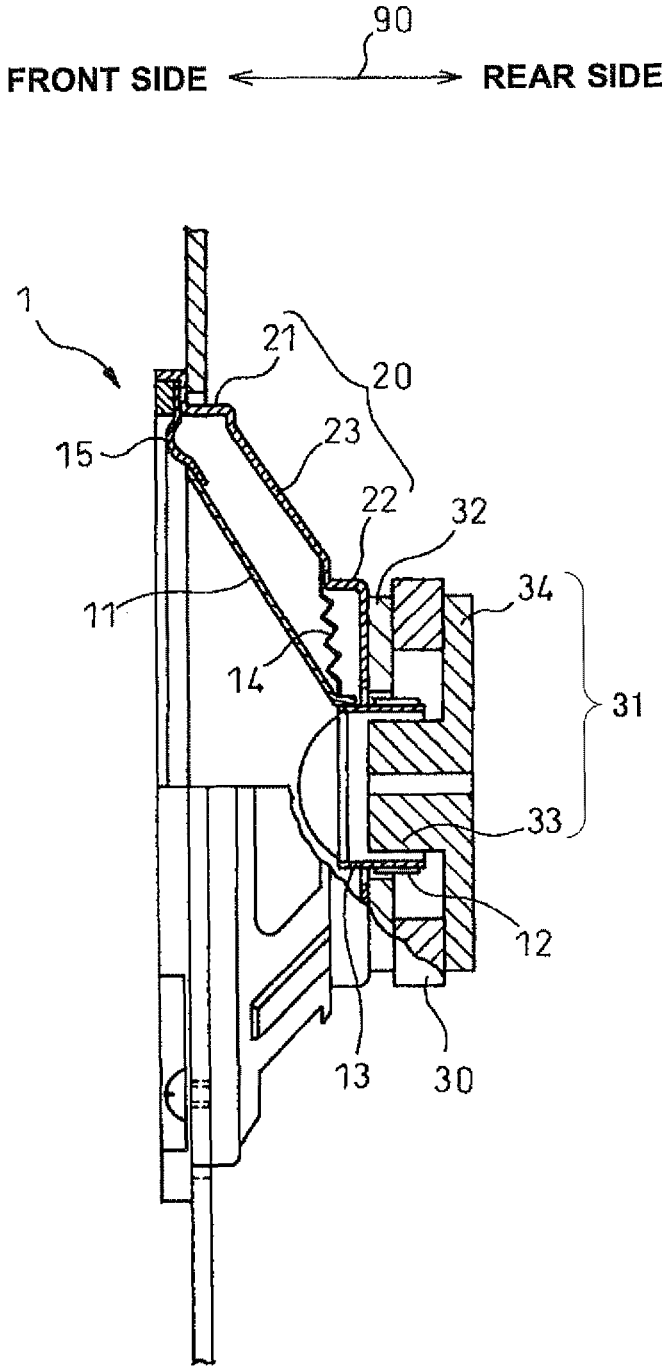
FIG. 1 shows a sectional view of a structure of a speaker unit.
Figure 5:
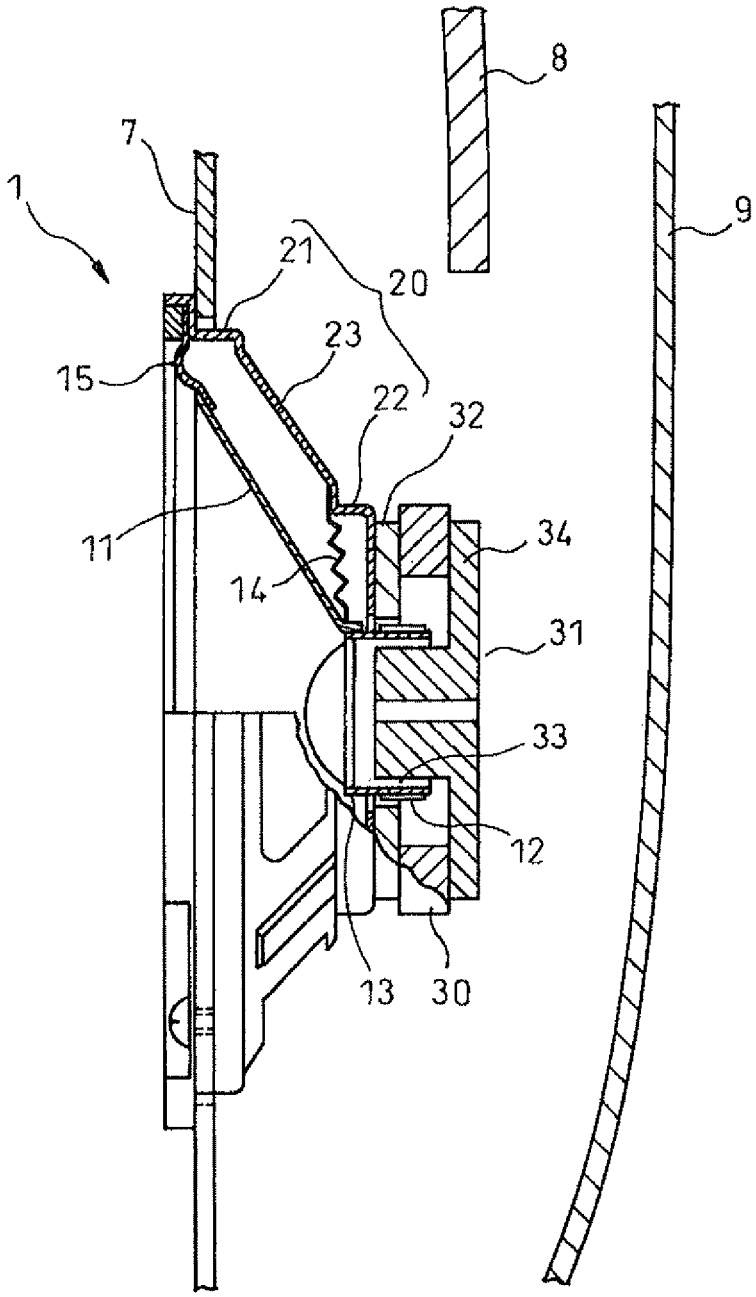
FIG. 5 shows a sectional view of an installation example of the speaker unit to a door.

FIG. 5 shows a sectional view of an installation example of the speaker unit 1 in a vehicle door. FIG. 5 uses the same reference numbers and symbols as the ones in FIG. 1 for components identical with the components of the speaker unit shown in reference to FIG. 1. That is, the component having the same number or symbol is the same unless otherwise specified.

As shown in FIG. 5, the speaker unit 1 is secured to the door trim 7. The speaker unit 1 is installed on the interior of a door, for example, with an attaching surface (described below) screwed to the door trim 7. A reference number 9 in FIG. 5 shows an outer panel of a vehicle.

Figure 6:
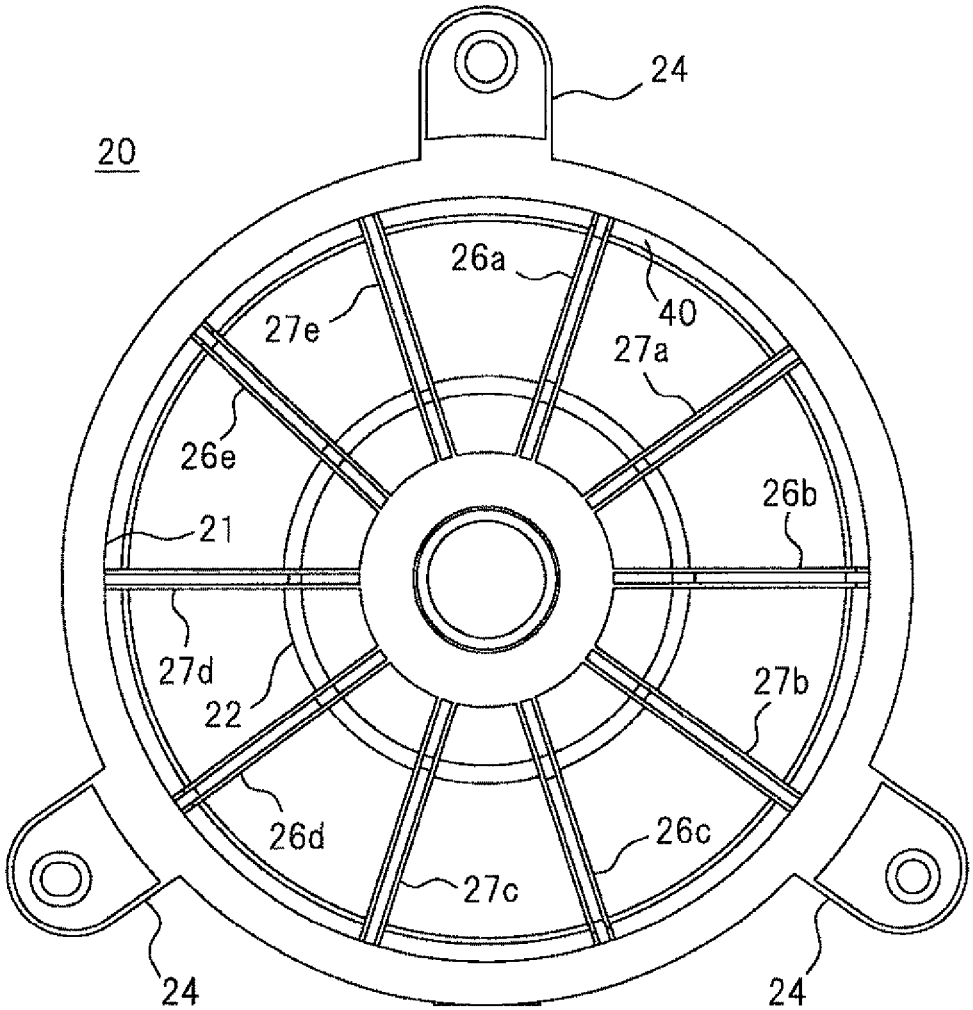
FIG. 6 shows a rear view of the first embodiment of a speaker supporter.
Figure 7:
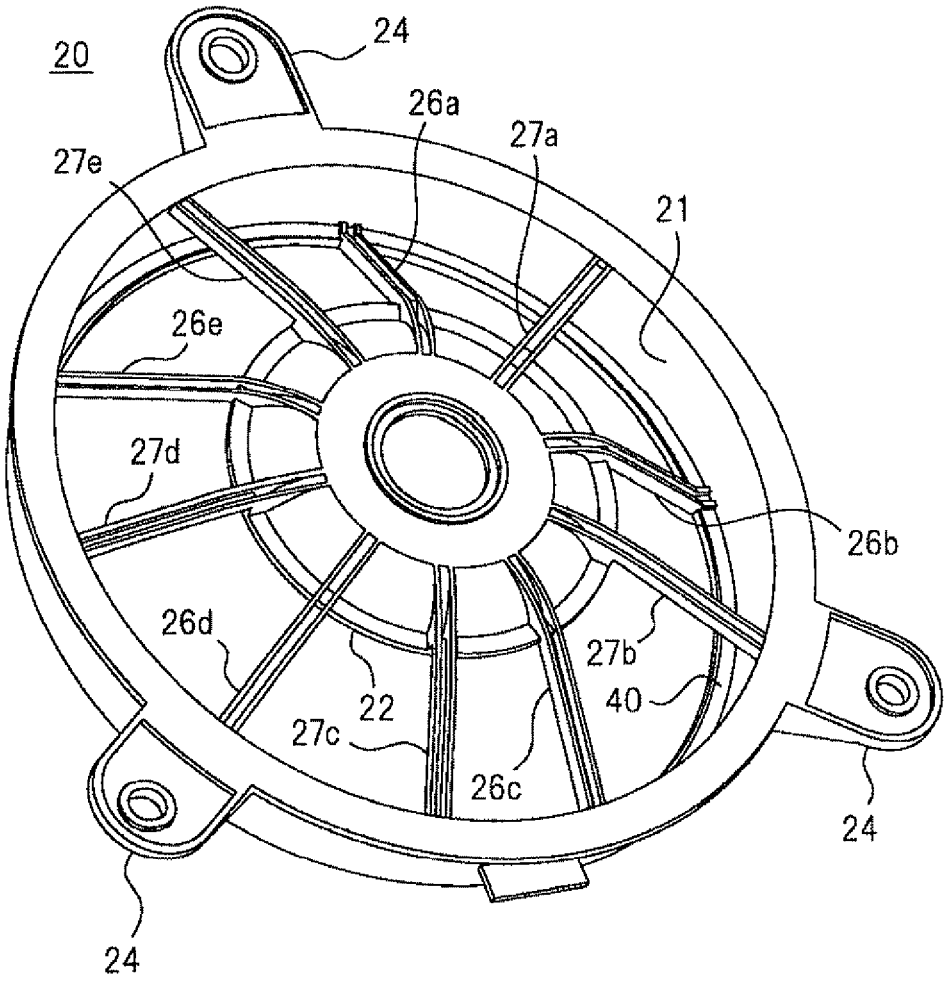
FIG. 7 shows a perspective view of the first embodiment of the speaker supporter.

Next, an embodiment of the speaker supporter 20 will be described. FIG. 6 shows a rear view of the first embodiment of the speaker supporter 20. FIG. 7 shows a perspective view of the first embodiment of the speaker supporter 20. The speaker supporter 20 has the frame 21 in a ring shape, the retainer 22, a first leg 26*a*, a first leg 26*b*, a first leg 26*e*, a first leg 26*d* and a first leg 26*e*, and a second leg 27*a*, a second leg 27*b*, a second leg 27*c*, a second leg 27*d* and a second leg 27*e*, and a flange 40. The speaker supporter 20 is made of, for example, acrylonitrile-butadiene-styrene copolymer resin (ABS resin) or polypropylene (PP), or mixture material of the resin above and fiberglass.

The frame 21 is secured to the edge part 15 that is attached and secured to the outer circumference of the diaphragm 11. The retainer 22 supports a magnetic circuit. The flange 40 is formed on the inner wall of the frame 21 in the vicinity of the front of the speaker.

Each of the first legs 26*a* to 26*e* connects to the retainer 22 and extends from the inner wall of the frame 21 in the vicinity of the front of the speaker to the retainer 22. This structure allows the retainer 22 and the frame 21 to be secured to each other. Each of the second legs 27*a* to 27*e* connects to the retainer 22 and extends from the inner wall of the frame 21 in the vicinity of the rear of the speaker to the retainer 22. This structure also allows the retainer 22 and the frame 21 to be secured to each other. As above, the magnetic circuit is secured to the frame 21 through the first legs 26*a* to 26; the second legs 27*a* to 27*e* and the retainer 22.

Hereafter, the first legs 26*a* to 26*e* may be described collectively as "first legs 26" (or "first leg 26" for one of the first legs 26). Besides, the second legs 27*a* to 27*e* may be described collectively as "second legs 27" (or "second leg 27" for one of the second legs 27).

An attaching surface 24 is formed on the outside wall of the frame 21. The speaker unit 1 is secured to the door trim 7, for example, with the attaching surface 24 screwed to an intended mounting surface of the door trim 7.

If the mounting surface attached by the attaching surface 24 has poor flatness, the attaching surface 24 becomes distorted. That is, when the flat surface including a plurality of the attaching surfaces 24 of the speaker supporter 20 attached to the door trim 7 does not bear a flat relationship with the surface of the frame 21, the speaker supporter 20 is installed in a warped state. In this case, the speaker supporter 20 is subject to deformation force that distorts a shape.

The distorted speaker supporter 20 may interfere with the movement of the voice coil bobbin 13 that vibrates the diaphragm 11. In this case, there is a risk that the sound quality or the performance of the speaker unit 1 is decreased, or that no sound is output in the worst case.

Figure 2:
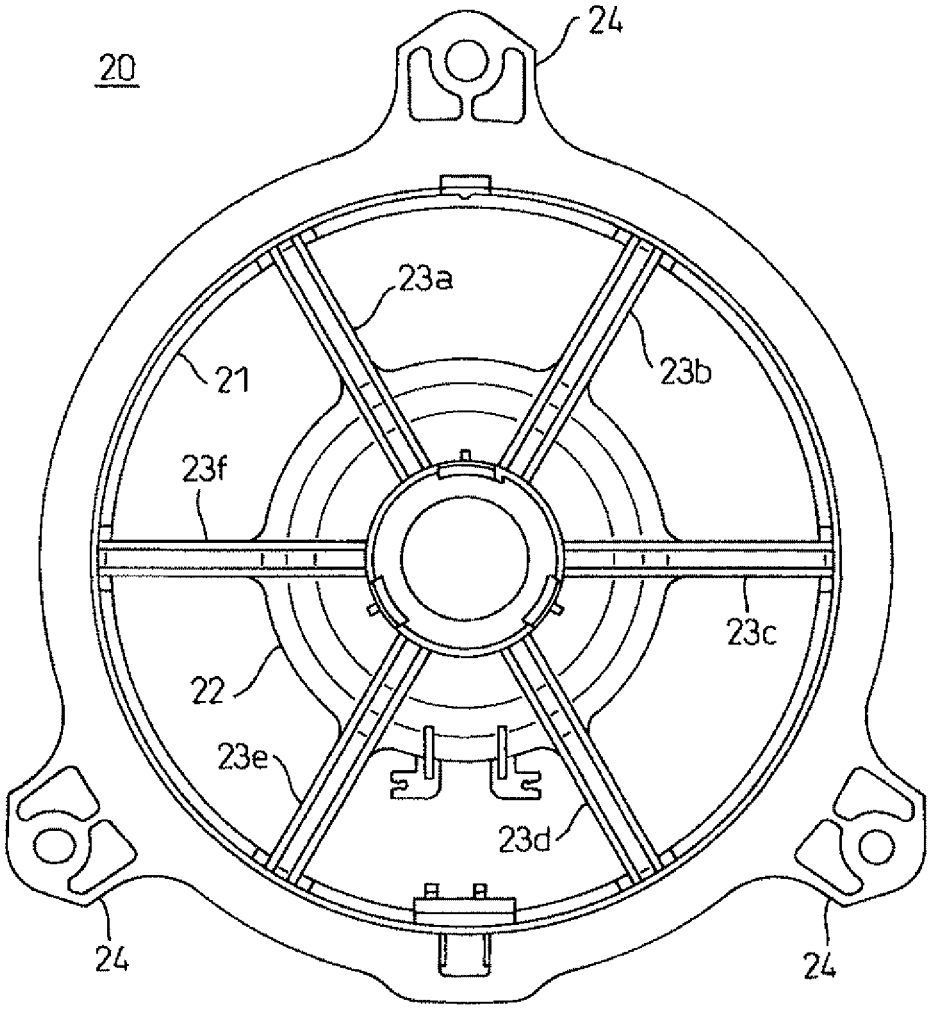
FIG. 2 shows a rear view of a speaker supporter.
Figure 3:
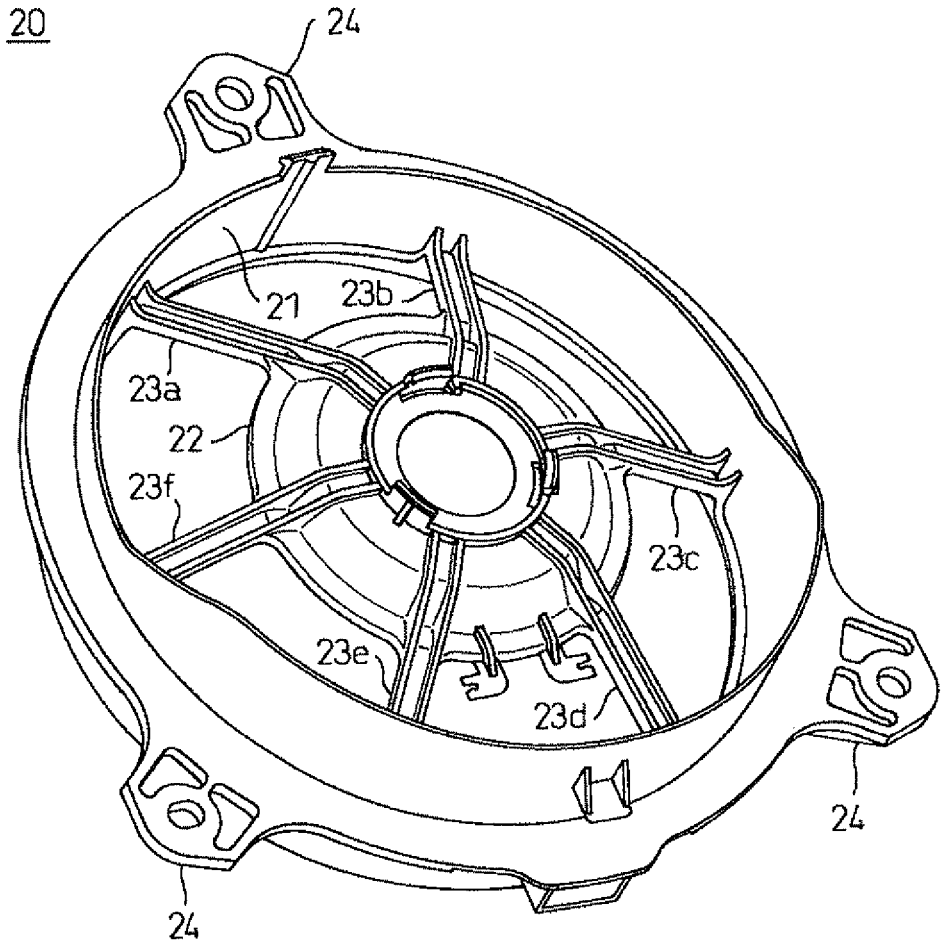
FIG. 3 shows a perspective view of the speaker supporter.

As well as the legs 23 of the speaker supporter in FIG. 2 and FIG. 3, the first legs 26 and the second legs 27 play roles as ribs to prevent deformation of the frame 21. In the example of FIG. 2 and FIG. 3, the connection points between the frame 21 and the legs 23 are arranged on the same flat surface. However, in the embodiment of FIGS. 6 and 7, the connection points between the frame 21 and the first legs 26 are arranged on the inner wall of the frame 21 in the vicinity of the front of the speaker, while the connection points between the frame 21 and the second legs 27 are arranged in the vicinity of the rear of the speaker, respectively.

As above, in the embodiment, the first legs 26 and the second legs 27 are arranged more sterically, compared to the example in FIG. 2 and FIG. 3. That is, the embodiment withstands force from wider vectors against deformation of the speaker supporter 20. Thus, the speaker supporter 20 has stronger resistance force against deformation force.

Further in the embodiment, the second legs 27 that are a part of the legs 26 and 27 connect to the frame 21 in the vicinity of the rear of the speaker. Thus, in the case where the attaching surface 24 is formed on the outside wall of the frame 21 in the vicinity of the rear of the speaker as shown in FIG. 7, this structure prevents the deformation occurring at the end portion of the frame 21 in the vicinity of the rear of the speaker at the time of installation through the attaching surface 24. The prevention of the deformation of the frame 21 in the portion relatively closer to the attaching surface 24 allows further prevention of deformation of the whole speaker supporter 20.

Compared to a conventional speaker supporter, the embodiment allows the components of the speaker supporter 20 to be made with a wall thickness that is half (or less than half), while keeping the resistance force against the deformation force. This enables lightening of the speaker supporter 20.

Looking at in-vehicle speakers, in accordance with the current trend toward smaller vehicles and future spread of hybrid vehicles, lighter vehicles will be more expected. Thus, the speakers for installation to these vehicles are to be reduced in weight while keeping sound quality and performance of the speakers, and this contributes to the reduction of vehicle's weight and enables differentiation from the conventional products.

Figure 8:
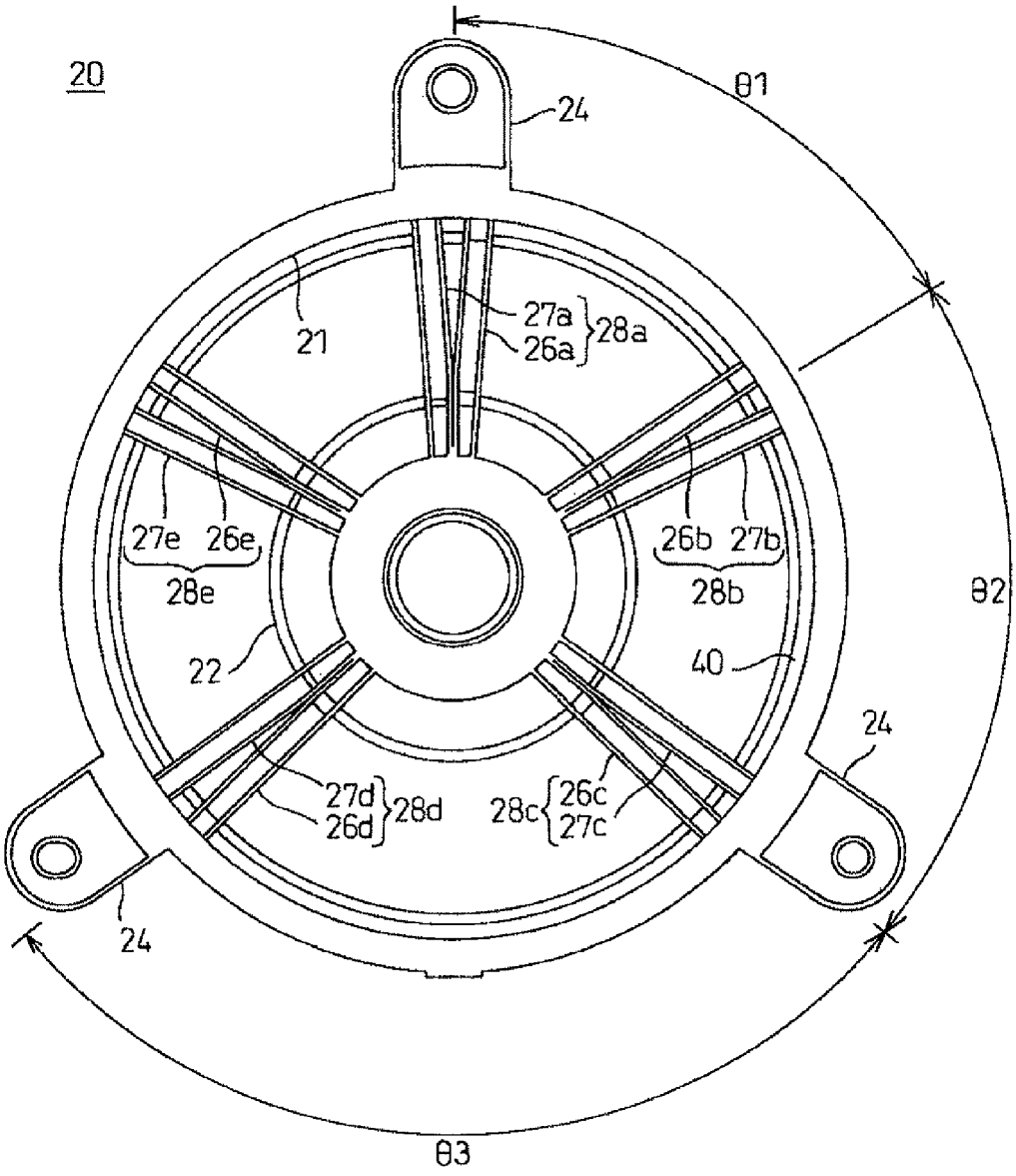
FIG. 8 shows a rear view of the second embodiment of a speaker supporter.
Figure 9:
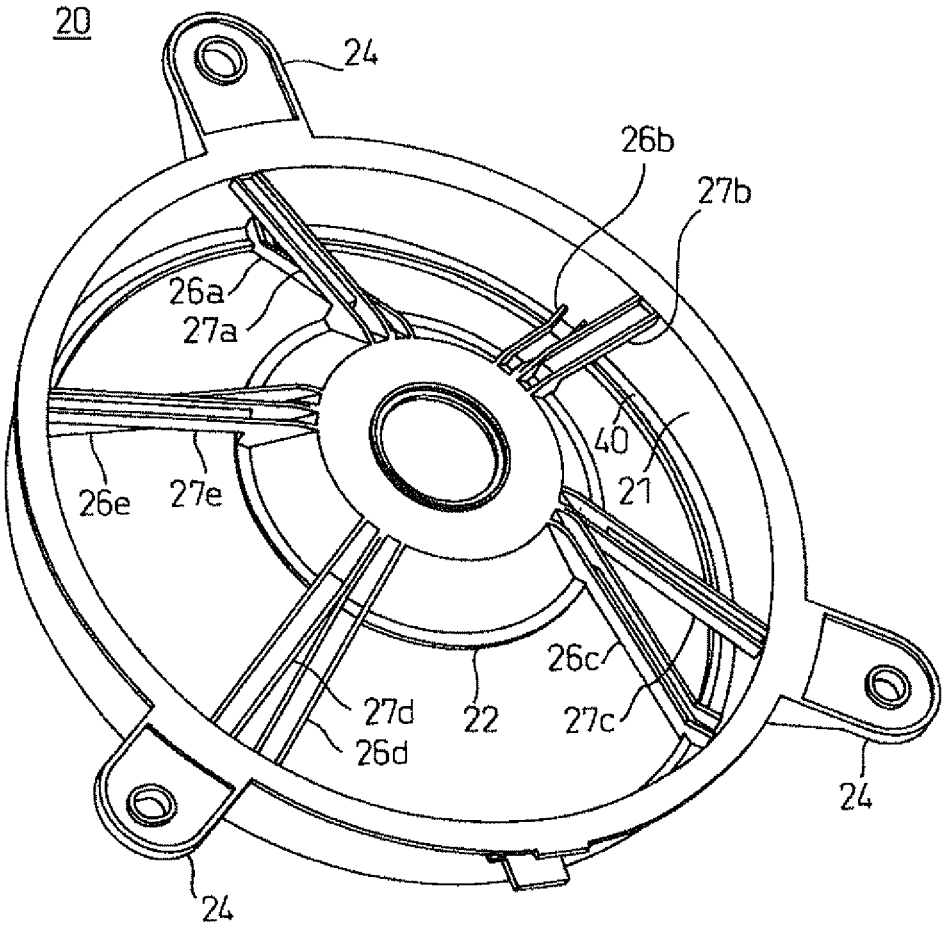
FIG. 9 shows a perspective view of the second embodiment of the speaker supporter.

Next, another embodiment of the speaker supporter 20 will be described. FIG. 8 shows a rear view of the second embodiment of the speaker supporter 20. FIG. 9 shows a perspective view of the second embodiment of the speaker supporter 20. FIG. 8 and FIG. 9 use the same reference numbers and symbols as the ones in FIG. 6 and FIG. 7, for the components identical with respective components of the speaker unit shown in reference to FIG. 6 and FIG. 7. The components indicated with the same number or symbol are the same unless otherwise specified.

In the embodiment, the speaker supporter 20 has a leg combination 28*a* having the first leg 26*a* and the second leg 27*a*, a leg combination 28*b* having the first leg 26*b* and the second leg 27*b*, a leg combination 28*c* having the first leg 26*c* and the second leg 27*c*, a leg combination 28*d* having the first leg 26*d* and the second leg 27*d*, and a leg combination 28*e* having the first leg 26*e* and the second leg 27*e*. Hereafter, the leg combinations 28*a* to 28*e* may be described collectively as "leg combinations 28" (or "leg combination 28" for one of the leg combinations 28).

The leg combination 28 has at least one first leg 26 and at least one second leg 27. That is, the leg combination 28 may have two or more first legs 26 and two or more second legs 27.

The leg combinations 28 are arranged as follows; the leg combination 28*a* is arranged next to the leg combination 28*b*, the leg combination 28*b* next to the leg combination 28*c*, the leg combination 28*c* next to the leg combination 28*d*, the leg combination 28*d* next to the leg combination 28*e*, and the leg combination 28*e* next to the leg combination 28*a*.

The first leg 26 and the second leg 27 included in the same leg combination 28 are respectively connected to the frame 21 at connection points. The interval between the two connection points is shorter than other intervals between the leg combinations 28 which are adjacent to each other. The interval between the two connection points is the length between the connection points on a circumferential direction of the frame 21.

In an example, the first leg 26*a*, arranged between the second leg 27*a* and the first leg 26*b*, is closer to the second leg 27*a* included in the same leg combination 28*a* than to the first leg 26*h* included in the leg combination 28*b* which is adjacent to the leg combination 28*a*. The interval between the first leg 26*a* and the second leg 27*a* is shorter than the interval between the leg combination 28*a* and the leg combination 28*b*.

As above, the first leg 26 and the second leg 27 are made into a combination and arranged closer each other. In terms of a line joining the connection points where respective legs and the frame 21 are connected, arranging the first leg 26 and the second leg 27 closer to each other allows the direction of the line to be closer to the front-back direction of the speaker unit 1 compared to the direction of such a line in the case of the first leg 26 and the second leg 27 being arranged apart from each other. Making the direction of the line joining the connection points closer to the front-back direction of the speaker unit 1 produces an effect similar to what would be obtained by the placement of a rib along the front-back direction. As a result, the speaker unit 1 has stronger resistance force against the deformation force applied in the front-back direction of the speaker unit 1. Further, compared to the case of the first leg 26 and the second leg 27 arranged apart from each other, the speaker unit 1 has stronger resistance force against the deformation force applied in a direction perpendicular to the front-back direction (the direction perpendicular to the extending direction of the rib, if any) of the speaker unit 1.

The angle between the two connection points on the frame 21 of the leg combination 28*a* and the leg combination 28*b* (the angle between the two extending directions of the leg combination 28*a* and the leg combination 28*b*) is shown as θ1. The angle between the two connection points of the leg combination 28*b* and the leg combination 28*c* (the angle between the two extending directions of the leg combination 28*b* and the leg combination 28*c*) is shown as θ2. The angle between the two connection points of the leg combination 28*c* and the leg combination 28*d* (the angle between the two extending directions of the leg combination 28*c* and the leg combination 28*d*) is shown as θ3. The angle between the two connection points of the leg combination 28*a* and the leg combination 28*e* (the angle between the two extending directions of the leg combination 28*a* and the leg combination 28*e*) is θ1, as well. The angle between the two connection points of the leg combination 28*e* and the leg combination 28*d* (the angle between the two extending directions of the leg combination 28*e* and the leg combination 28*d*) is θ2, as well.

In an example, the angle θ3 between the leg combination 28*c* and the leg combination 28*d* may be wider than the other angles θ1 and θ2. Widening the interval between the leg combination 28*e* and the leg combination 28*d* enables easier arrangement designing for components of the speaker unit 1 in the space between the leg combination 28*c* and the leg combination 28*d*. In the space between the leg combination 28*c* and the leg combination 28*d*, an input terminal may be arranged, for example.

Figure 10:
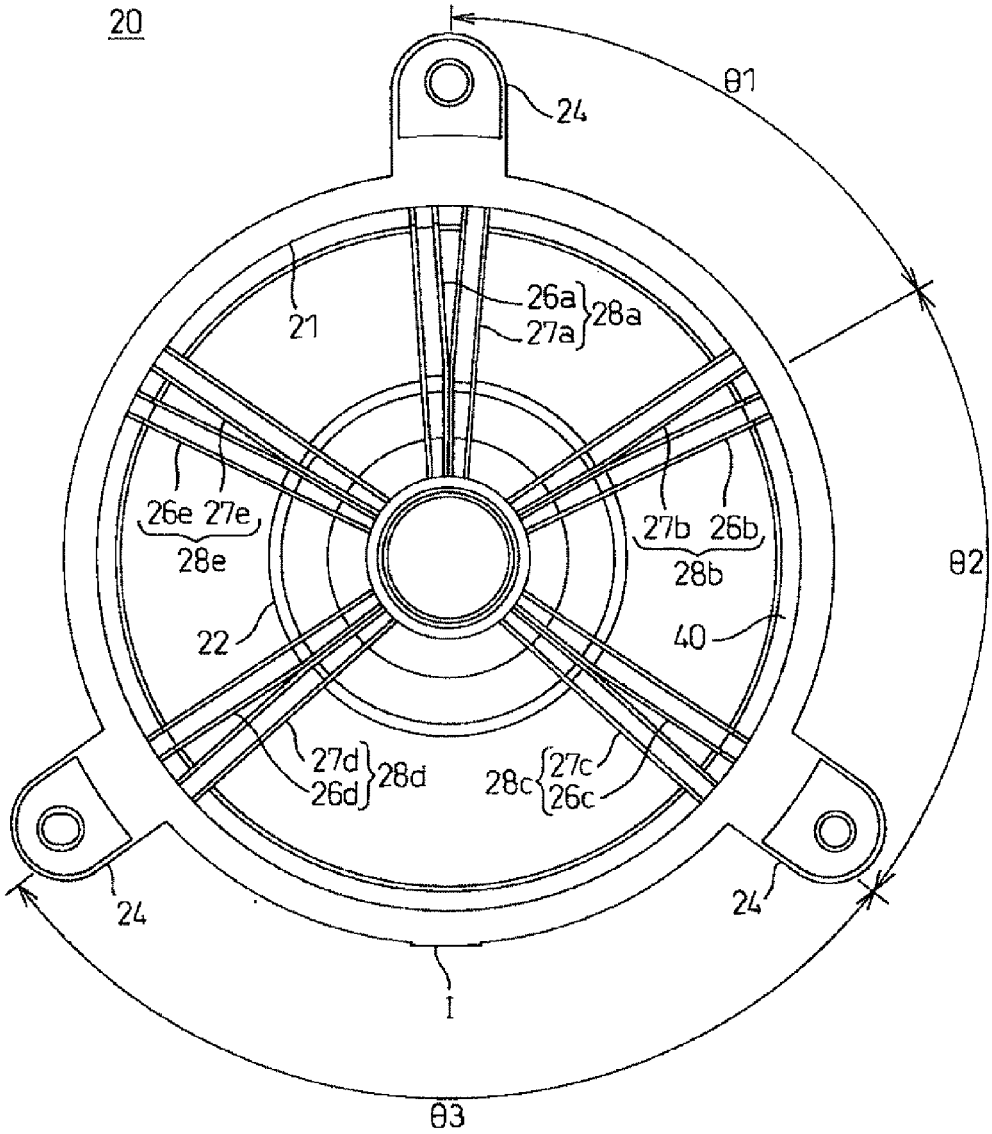
FIG. 10 shows a rear view of the third embodiment of a speaker supporter.
Figure 11:
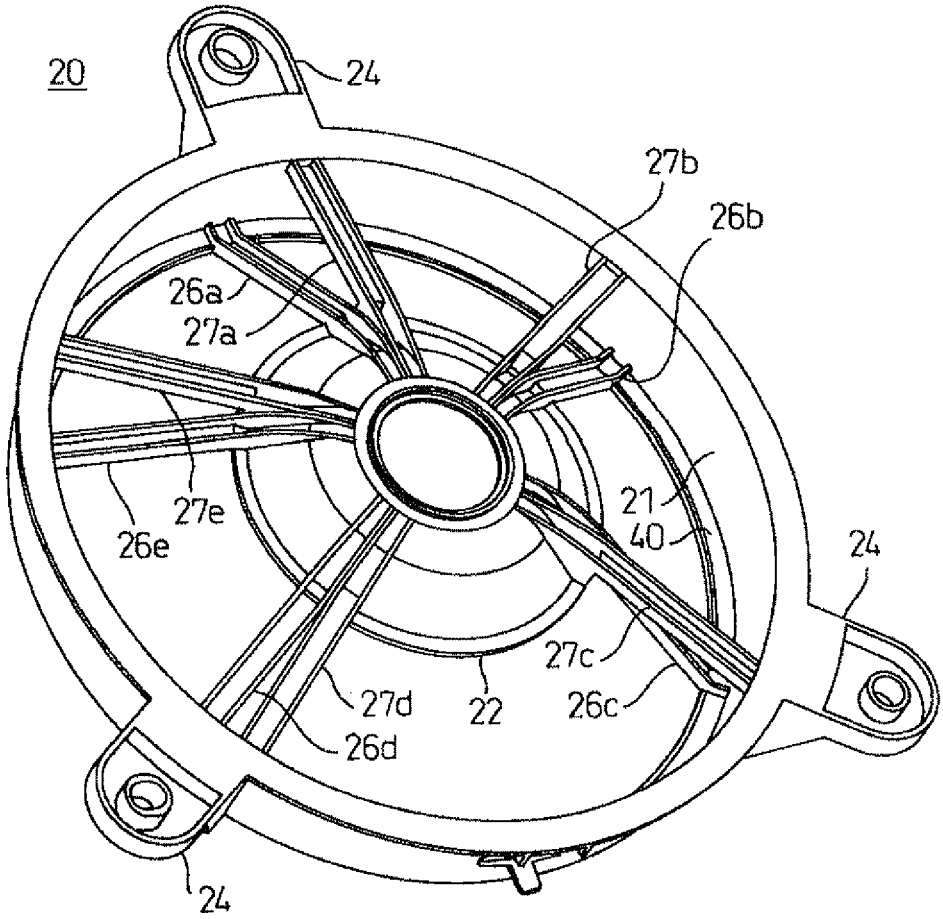
FIG. 11 shows a perspective view of the third embodiment of the speaker supporter.

Next, another embodiment of the speaker supporter 20 will be described. FIG. 10 shows a rear view of the third embodiment of the speaker supporter 20. FIG. 11 shows a perspective view of the third embodiment of the speaker supporter 20. FIG. 10 and FIG. 11 use the same reference numbers and symbols as the ones in FIG. 8 and FIG. 9, for the components identical with respective components of the speaker unit shown in reference to FIG. 8 and FIG. 9. The components indicated with the same number or symbol are the same unless otherwise specified.

The indication method of the reference numbers and symbols in terms of the respective angles between the leg combinations 28 is identical with the method of the second embodiment described in reference to FIG. 8 and FIG. 9. In the embodiment as well, the angle θ3 between the two extending directions of the leg combination 28*c* and the leg combination 28*d* is wider than the other angles θ1 and θ2. The attaching surface 24 is formed on the outside wall of the frame 21 in the vicinity of the rear of the speaker.

In the embodiment, the second leg 27*c* of the leg combination 28*c* and the second leg 27*d* of the leg combination 28*d* are arranged next to each other. That is, the second leg 27*c* and the second leg 27*d*, but the first leg 26*c* and the first leg 26*d*, are arranged at the both ends of an interval I that is the widest interval in the intervals divided by the leg combinations 28 on the frame 21. In other words, the interval I is allocated between the second leg 27*c* and the second leg 27*d*, and neither the first leg 26*c* nor the first leg 26*d* are arranged between the second leg 27*c* and the second leg 27*d*.

This arrangement reduces the deformation occurring on the frame 21 through the attaching surface 24 when the speaker unit 1 is attached. Since the resistance force against deformation force is weak in the interval I where an arrangement interval is wide, deformation tends to occur in the vicinity of the rear of the speaker, where the attaching surface 24 is formed. Thus, the embodiment shortens the interval I that is the interval between two legs of the second legs 27, and this reduces the deformation of the frame 21 at the portion relatively close to the attaching surface 24. As a result, the embodiment enables the reduction of the deformation of the whole speaker supporter 20.

According to the embodiment, uneven arrangement of the intervals of the leg combinations 28 also makes the speaker unit 1 stronger. The embodiment contributes to more flexible designing in terms of the arrangement intervals of the leg combinations 28.

Figure 12:
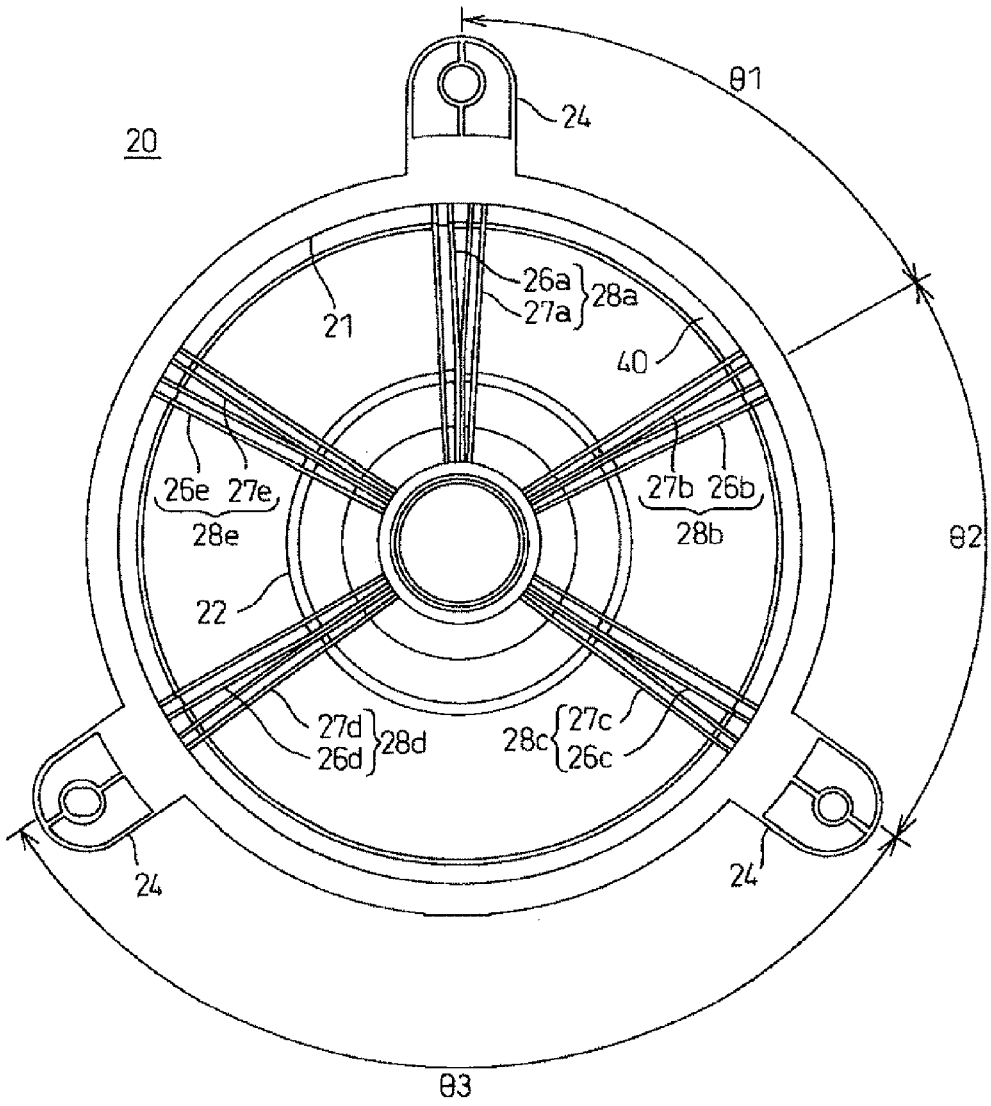
FIG. 12 shows a rear view of the fourth embodiment of a speaker supporter.
Figure 13:
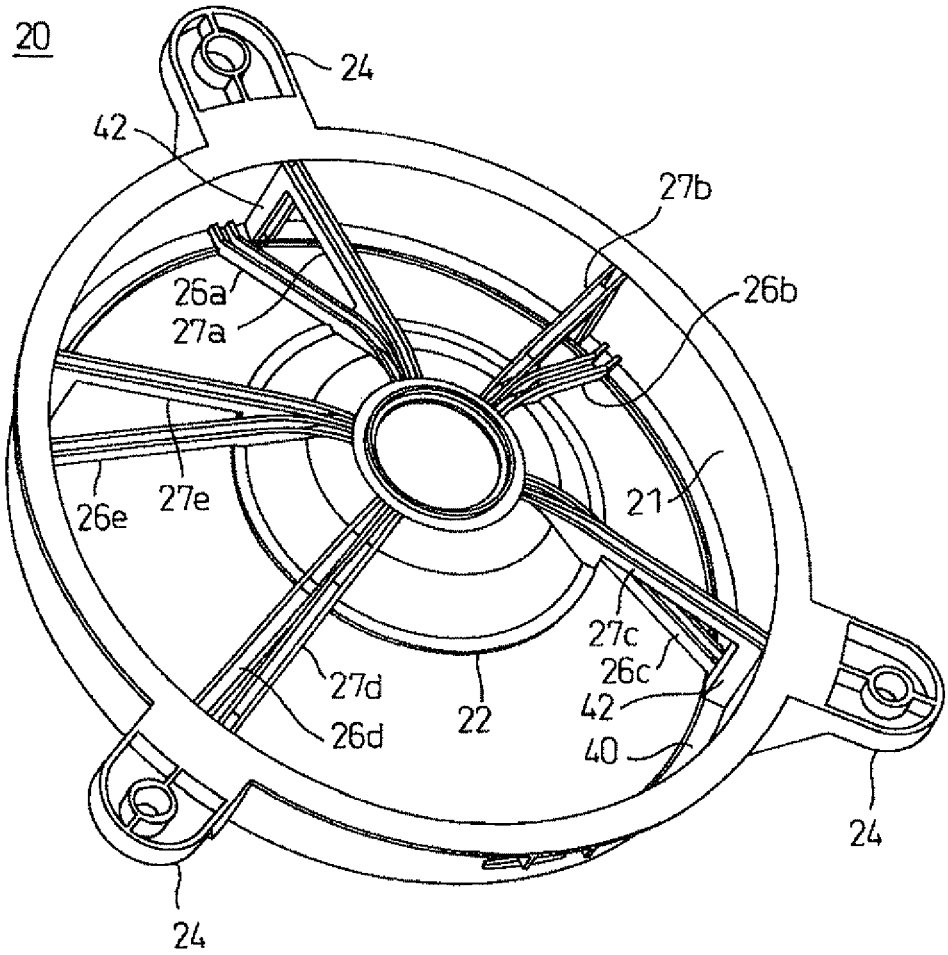
FIG. 13 shows a perspective view of the fourth embodiment of the speaker supporter.

Next, another embodiment of the speaker supporter 20 will be described. FIG. 12 shows a rear view of the fourth embodiment of the speaker supporter 20. FIG. 13 shows a perspective view of the fourth embodiment of the speaker supporter 20. FIG. 12 and FIG. 13 use the same reference numbers and symbols as the ones in FIG. 10 and FIG. 11, for the components identical with respective components of the speaker unit shown in reference to FIG. 10 and FIG. 11. The components indicated with the same number or symbol are the same unless otherwise specified.

In the embodiment, a rib 42 is formed on the frame 21. The rib 42 is formed so as to fill the gap between the flange 40 and the connection point of the second leg 27 on the frame 21. Filling the gap with the rib 42 between the flange 40 and the connection point of the second leg 27 allows easier molding processing of the speaker supporter 20.

In other embodiments described in reference to FIGS. 6 to 11, the rib 42 may be formed as well so as to fill the gap between the flange 40 and the connection point of the second leg 27 on the frame 21.

Figure 14:
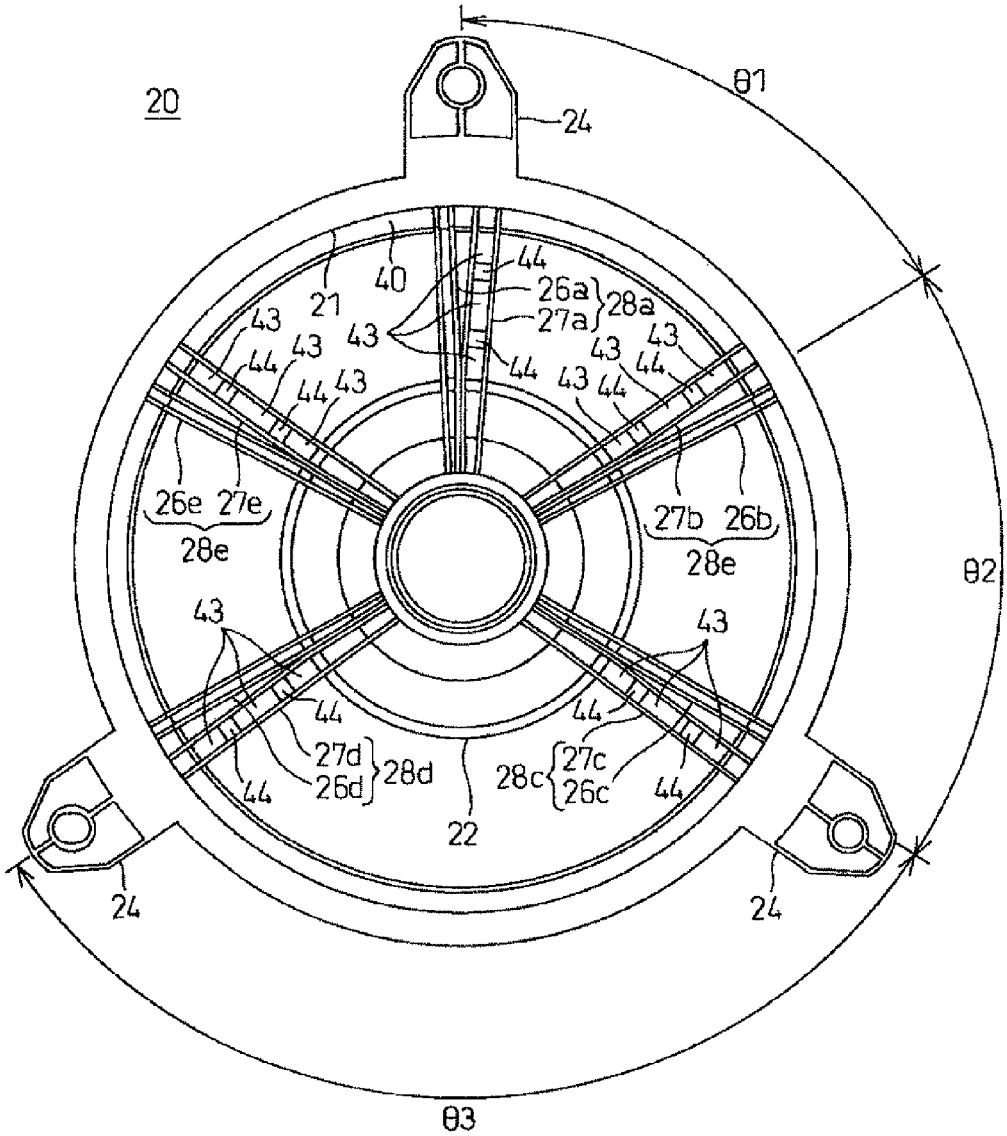
FIG. 14 shows a rear view of the fifth embodiment of a speaker supporter.
Figure 15:
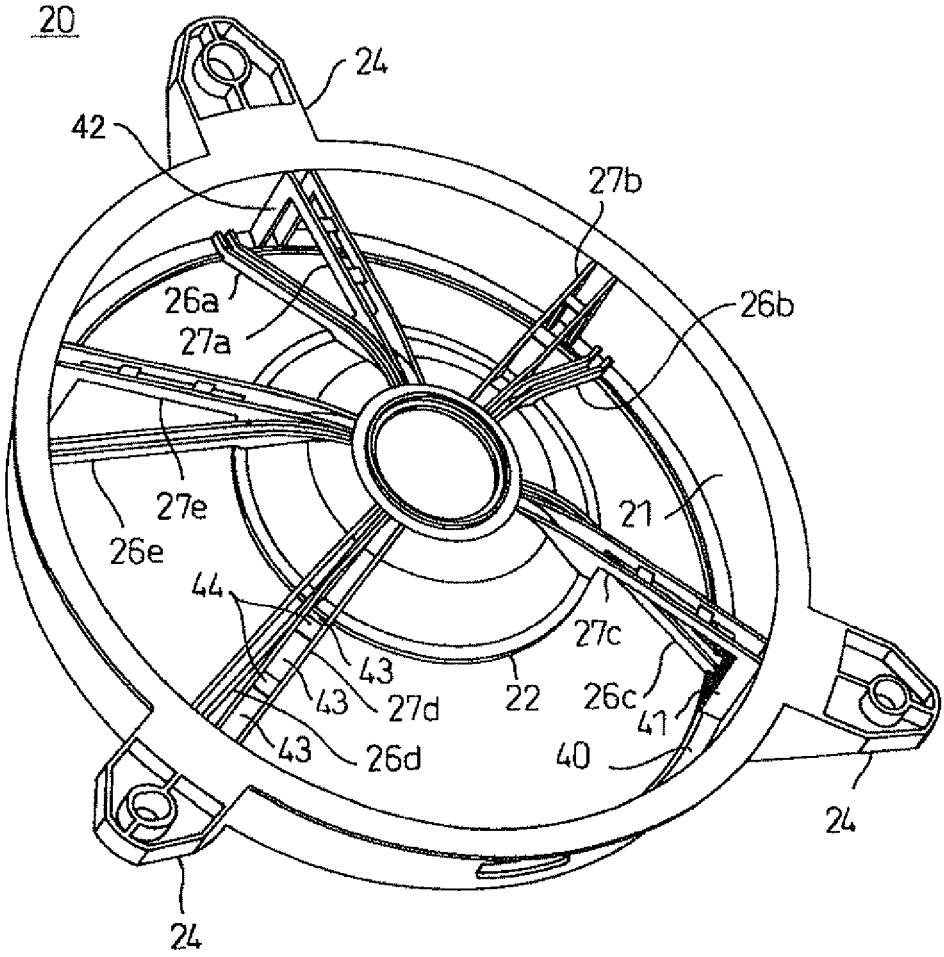
FIG. 15 shows a perspective view of the fifth embodiment of the speaker supporter.

Next, another embodiment of the speaker supporter 20 will be described. FIG. 14 shows a rear view of the fifth embodiment of the speaker supporter 20. FIG. 15 shows a perspective view of the fifth embodiment of the speaker supporter 20. FIG. 14 and FIG. 15 use the same reference numbers and symbols as the ones in FIG. 12 and FIG. 13, for the components identical with respective components of the speaker unit described in reference to FIG. 12 and FIG. 13. The components indicated with the same number or symbol are the same unless otherwise specified.

In the embodiment, each of the second legs 27 has a weight-reducing hole 43 and a bridge 44 that connects two internal faces of the side surfaces of the second leg 27. Forming the weight-reducing hole 43 in the second leg 27 makes the speaker supporter 20 lighter. Forming the bridge 44 at an opening portion created due to the weight-reducing hole 43 makes the second leg 27 stronger. That is, in the embodiment, forming the weight-reducing hole 43 and the bridge 44 enables both of weight-reducing and strengthening.

FIG. 15 shows reference numbers of the weight-reducing holes and the bridges only in terms of the second leg 27*d*. However, other legs of the second legs 27*a* to 27*c* and 27*e* have the weight-reducing holes 43 and the bridges 44, as well. The first legs 26 may have the weight-reducing hole and the bridge, as well. Further, in other embodiments as well, the first legs 26 and/or the second legs 27 may have the weight-reducing holes and the bridges.

Figure 16:
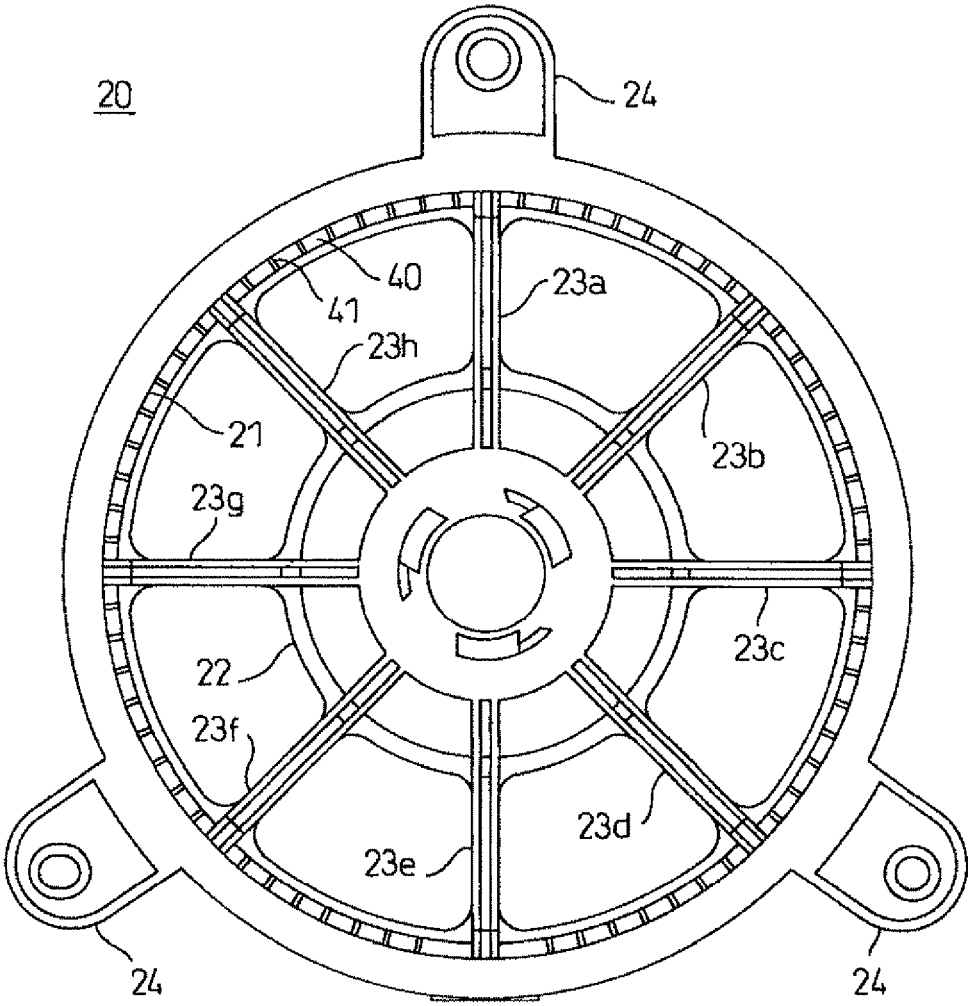
FIG. 16 shows a rear view of the sixth embodiment of a speaker supporter.
Figure 17:
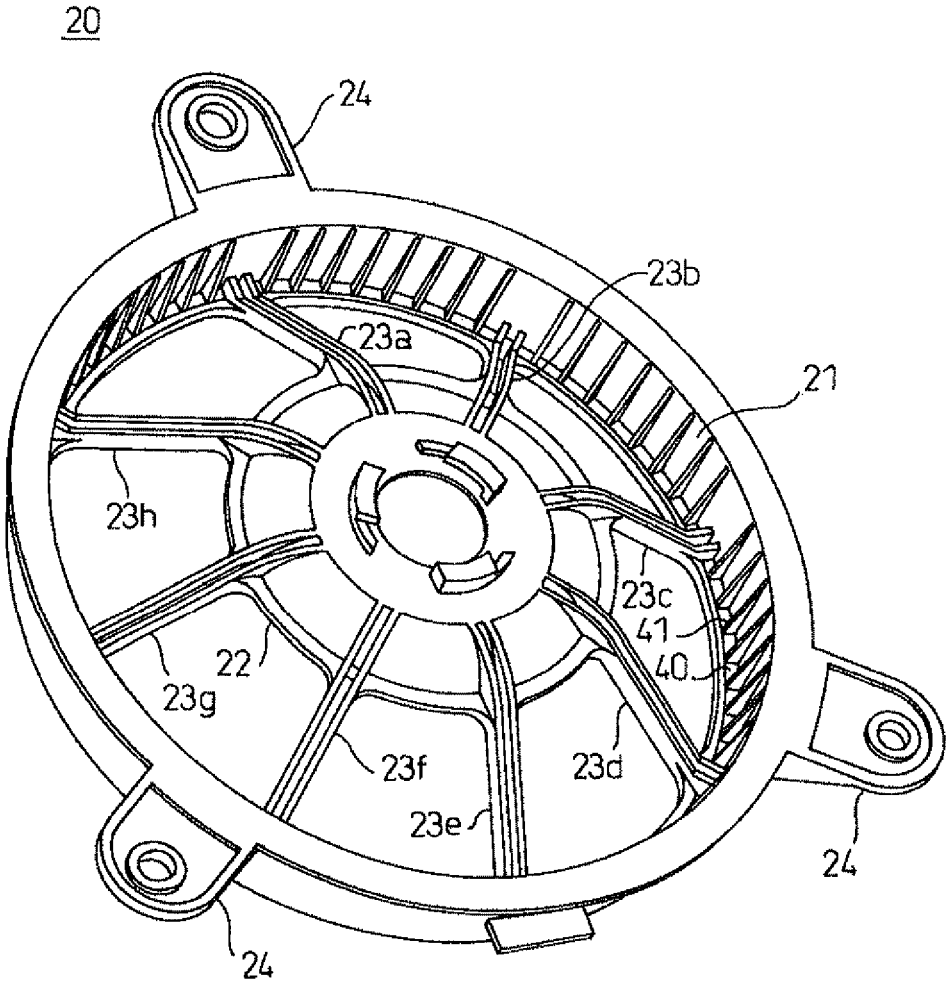
FIG. 17 shows a perspective view of the sixth embodiment of the speaker supporter.

Next, another embodiment of the speaker supporter 20 will be described. FIG. 16 shows a rear view of the sixth embodiment of the speaker supporter 20. FIG. 17 shows a perspective view of the sixth embodiment of the speaker supporter 20. FIG. 16 and FIG. 17 use the same reference numbers and symbols as the ones in FIG. 6 and FIG. 7, for the components identical with respective components of the speaker unit described in reference to FIG. 6 and FIG. 7. The components indicated with the same number or symbol are the same unless otherwise specified. The speaker supporter 20 has the legs 23*a* to 23*h*, the flange 40 and a plurality of ribs 41.

Each of the eight legs of the legs 23*a* to 23*h* is connected to the retainer 22 and extends from the inner wall of the frame 21 in the vicinity of the front of the speaker. This structure allows the retainer 22 and the frame 21 to be secured to each other. That is, the magnetic circuit is secured to the frame 21 through the legs 23*a* to 23*h* and the retainer 22. The plurality of ribs 41 are formed so as to connect to the inner wall of the frame 21 and the flange 40.

The embodiment has eight legs of the legs 23 for securing the retainer 22 to the frame 21, while the example in FIG. 2 and FIG. 3 has six legs. Since the legs 23 play roles of ribs for reducing the deformation of the speaker supporter 20, increasing the legs of the legs 23 strengthens the resistance force against the deformation force applied to the speaker supporter 20.

The action of the ribs 41 formed on the inner wall of the frame 21 strengthens the resistance force against the deformation force applied in the extending direction (front-back direction of the speaker) of the ribs 41. Compared to the case without the ribs 41, the speaker supporter 20 has stronger resistance force against the deformation force applied in a direction perpendicular to the extending direction of the ribs 41, as well. Compared to a conventional speaker supporter, the action of the ribs 41 and the increase of the legs 23 enable the wall thickness of the speaker supporter 20 to be reduced to half (or less than half), while the resistance force against the deformation force is kept. This makes the speaker supporter 20 lighter.

In other embodiments described in reference to FIGS. 6 to 13 as well, the plurality of ribs 41 may be formed so as to connect to the inner wall of the frame 21 and the flange 40. In the embodiment, the legs 23 may have the weight-reducing holes and the bridges, as well.

While the invention has been shown and described in detail, the foregoing description is in all aspects illustrative and not restrictive. It is therefore understood that numerous other modifications and variations can be devised without departing from the scope of the invention.

What is claimed is:

1. A speaker unit, comprising:

a frame that secures a diaphragm of a speaker at an outer circumference of the diaphragm;

a magnetic circuit;

a first leg that extends from a portion of an inner wall of the frame in a vicinity of a front of the speaker to a center of the magnetic circuit, and that secures the magnetic circuit to the frame; and a second leg that extends from a portion of the inner wall of the frame in a vicinity of a rear of the speaker to the center of the magnetic circuit, and that secures the magnetic circuit to the frame, the first leg and the second leg each extending to end at concyclic points on the magnetic circuit in a front-back direction of the speaker.

2. The speaker unit of claim 1, further comprising:

a plurality of leg combinations each including at least one of the first legs and at least one of the second legs, wherein the first leg and the second leg included in one of the leg combinations are spaced from each other by a first interval that is smaller than a second interval by which adjacent leg combinations are spaced from each other.

3. The speaker unit of claim 2, further comprising:

an attaching surface that is formed on the frame in the vicinity of the rear of the speaker; and three or more of the leg combinations, wherein the leg combinations are arranged such that an interval between a first leg combination and a second leg combination is wider than respective intervals between all other leg combinations, and the first leg and the second leg of the first and second leg combinations are arranged such that the second leg included in the first leg combination and the second leg included in the second leg combination are adjacent to each other.

4. The speaker unit of claim 1, further comprising:

a flange that is formed in a portion of the inner wall of the frame in the vicinity of the front of the speaker; and a rib that fills a gap between the flange and the second leg.

5. The speaker unit of claim 1, wherein at least one of the first and the second legs has a weight-reducing hole.

6. The speaker unit of claim 4, wherein the rib connects to the flange and the inner wall of the frame.

7. A speaker unit, comprising:

a frame that secures a diaphragm of a speaker at an outer circumference of the diaphragm, the frame having a front end and a rear end;

a magnetic circuit;

a first leg having an outer end that is attached to a portion of an inner wall of the frame at the front end of the frame and an inner end that is attached to the magnetic circuit to secure the magnetic circuit to the frame; and a second leg having an outer end that is attached to a portion of the inner wall of the frame at the rear end of the frame and an inner end that is attached to the magnetic circuit to secure the magnetic circuit to the frame, wherein the first leg and the second leg are each attached to the magnetic circuit at concyclic points in a front-back direction of the speaker, and the first leg and the second leg each extend toward a center of the magnetic circuit.

8. The speaker unit of claim 7, further comprising:

a plurality of leg combinations each including at least one of the first legs and at least one of the second legs, wherein the first leg and the second leg included in one of the leg combinations are spaced from each other along a circumference of the frame by a first interval that is smaller than a second interval by which adjacent leg combinations are spaced from each other along the circumference of the frame.

9. The speaker unit of claim 8, further comprising:

an attaching member formed on the frame at the rear end of the frame for attaching the speaker unit to a mounting surface; and three or more of the leg combinations, wherein the leg combinations are arranged such that an interval between a first leg combination and a second leg combination along the circumference of the frame is wider than respective intervals along the circumference of the frame between all other leg combinations, and the first leg and the second leg of the first and second leg combinations are arranged such that the second leg included in the first leg combination and the second leg included in the second leg combination are adjacent to each other.

10. The speaker unit of claim 7, further comprising:

a flange that is formed in a portion of the inner wall of the frame at the front end of the frame; and a rib extending between the flange and the second leg.

11. The speaker unit of claim 7 wherein at least one of the first and second legs has a weight-reducing hole.

12. The speaker unit of claim 10, wherein the rib connects to the flange and the inner wall of the frame.

* * * * *